US005185492A

United States Patent [19]

Ikeya

[11] Patent Number: 5,185,492

[45] Date of Patent: Feb. 9, 1993

[54] ELECTRONIC MUSICAL INSTRUMENT HAVING MULTIVOICE FUNCTION FOR GENERATING MUSICAL TONES OF PLURAL TONE COLORS

[75] Inventor: Tadahiko Ikeya, Hamamatsu, Japan

[73] Assignee: Yamaha Corporation, Hamamatsu, Japan

[21] Appl. No.: 738,216

[22] Filed: Jul. 30, 1991

[30] Foreign Application Priority Data

Jul. 30, 1990 [JP] Japan ..... 2-202784

[51] Int. Cl.[5] ..... G10H 1/06; G10H 1/08; G10H 1/24

[52] U.S. Cl. ..... 84/633; 84/622; 84/665; 84/DIG. 2

[58] Field of Search ..... 84/622, DIG. 2, DIG. 22, 84/613, 625, 615, DIG. 10, 697, 623, 633, 659, 665

[56] References Cited

U.S. PATENT DOCUMENTS

| | | | |
|---|---|---|---|
| 4,138,915 | 2/1979 | Nagai et al. | 84/623 |
| 4,614,145 | 9/1986 | Chibana | 84/DIG. 10 |
| 5,044,251 | 9/1991 | Matsuda et al. | 84/615 |
| 5,074,183 | 12/1991 | Chibana | 84/622 |

*Primary Examiner*—William M. Shoop, Jr.
*Assistant Examiner*—Helen Kim
*Attorney, Agent, or Firm*—Spensley Horn Jubas & Lubitz

[57] ABSTRACT

An electronic musical instrument having a function of simultaneously generating musical tones of a plural tone color comprises a tone color designating device for designating a plurality of tone colors, and a balance decision device for deciding balance of tone volume between the tones of tone colors designated by the tone color designating device, according to the order specified thereby. After the tone colors are designated, when musical tone generation is specified by a keyboard or the like, the musical tones of the tone colors are generated according to the previously decided balance of tone volume.

19 Claims, 7 Drawing Sheets

| |
|---|
| N |
| MOD |
| KCD(N) |
| KVL |
| CHN(N,0) |
| CNN(N,1) |
| OFKC |
| VOICE(0/1) |
| SVOL(0/1) |

ELECTRONIC MUSICAL INSTRUMENT HAVING MULTIVOICE FUNCTION FOR GENERATING MUSICAL TONES OF PLURAL TONE COLORS

BACKGROUND OF THE INVENTION

1. Field of the Invention

This invention relates to an electronic musical instrument which is capable of generating a plural tone color simultaneously.

2. Description of the Prior Art

Electronic musical instruments being capable of simultaneously generating tones of a plural tone color have been used. These multivoice type instruments generally have two generating tone modes , a dual mode and a split mode. The dual mode is a mode in which when a tone pitch is designated, musical tones of a plural tone color are generated at the tone pitch. The split mode is a mode in which a range of a playing portion like a keyboard is divided into two or more portions, and each of the portions is assigned to a different tone color.

In the above-mentioned modes, conventionally, tone volume of the plural tone color is fixed, so that when a plural tone color is designated, the rate of the tone volume is a fixed value. This eliminates any degrees of freedom in musical tones and monotonous tone colors. Although electronic musical instruments in which tone volume is set for each tone color so that tone volume balance of each tone color can be set are proposed, such operation is complicated and doesn't allow a player to easily and speedily change a tone color.

SUMMARY OF THE INVENTION

It is therefore an object of the present invention to provide an electronic musical instrument having multivoice function which allows a player to set balance of tone volume between a plural tone with easy operation.

In accordance with the present invention, an electronic musical instrument having a multivoice function comprises musical tone generating means for simultaneously generating musical tones of a plurality of tone color, tone color designating means for designating a plurality of tone colors in a predetermined specified order, balance decision means for deciding balance of tone volume between the tones of tone colors designated by the tone color designating means, according to the order specified by the tone color designating means.

The present invention allows tone volume balance of a plural tone to be decided with specified order of tone colors, resulting in musical varieties in the dual mode and the split mode to improve musical expression. The present invention also allows a player not to do any special operation to make operation easier.

DETAILED OF THE PREFERRED EMBODIMENTS

Figures 1, 3:
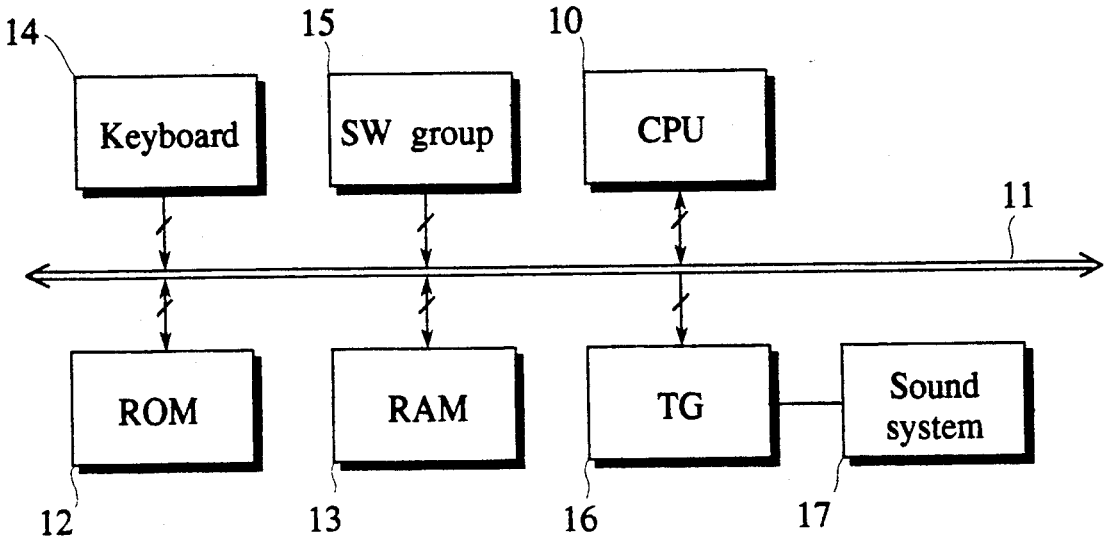
FIG. 1 is a block diagram of an electronic musical instrument embodying the present invention.
FIG. 3 shows a portion of a memory map of the electronic musical instrument.

FIG. 1 is a block diagram of the electronic musical instrument embodying the present invention.

The electronic musical instrument is an electronic keyboard type musical instrument having a keyboard 14, in which when a player depresses a key of the keyboard, a plural musical tone is generated simultaneously.

The musical instrument is mainly controlled by a CPU 10. To the CPU, ROM 12, RAM 13, keyboard 14, a switches group 15, and a tone generator 16 are connected through a bus 11. The ROM 12 stores a program ,tone colors data Or the like. The RAM 13 includes registers which store data ,generated when a key is depressed, or the like. The switches group 15 includes a mode change switch, tone color switch or the like. The mode change switch is a switch which alternates between a dual mode and a normal mode. The dual mode means that a musical tone of two tone colors is generated with one key depression, while the normal mode means that a musical tone of one tone color is generated with one key depression. The tone color switch is a switch for selection of a tone color to be generated.

Figure 2:
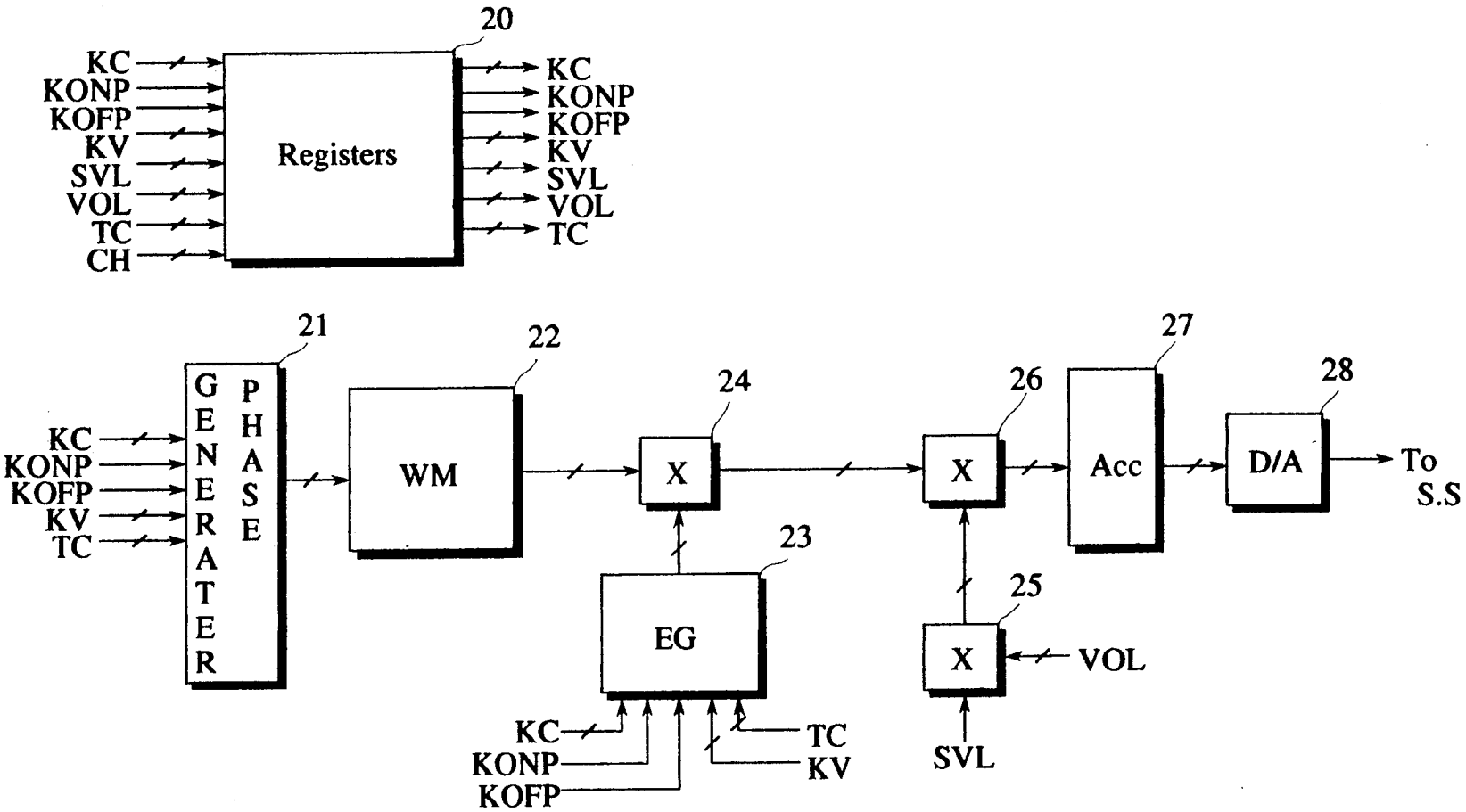
FIG. 2 is a block diagram of a tone generator of the electronic musical instrument.

FIG. 2 shows a configuration of the tone generator 16. The tone generator 16 adopts a wave memory system, in which some addresses are formed based on several parameters input from the CPU 10. A wave memory 22 is accessed with the address, and wave data is read. The tone generator 16 works in time sharing to form plural (sixteen types) wave form data simultaneously. Each time shared timing corresponds to on tone generating channel. That is, in this system, each time sharing process divided into sixteen slots is performed depending on the same clock. The wave memory 22 stores wave data of each tone color. One wave data consists of attack portion and repeat portion. The attack portion is read at the beginning of tone generation and the repeat portion is read repeatedly during the time in tone generation.

A register 20 is connected to the bus 11. To the register, data of key code KC, key on pulse KONP, key off pulse KOFP, key velocity KV, subvolume SVL, main volume VOL, tone color number IC, and assigned channel CH are inputted. The CPU 10 outputs the data into the register 20 at arbitrary timing (after a key event is occurred).

The register 20 outputs the input data from the CPU 10 into each circuit at time share timing assigned to a channel. A phase generator 21 is connected to an address input terminal of the wave memory 22. Into the phase generator 21, data of the key code KC, the key on pulse KONP, the key off pulse KOFP, the key velocity KV, and the tone color number TC are inputted. The phase generator 21 decides address data and reads timing to the wave memory 22 based on the above mentioned data. Wave data (instantaneous value of a musical tone wave) is read from the wave memory 22 according to the address data inputted from the phase generator 21. The wave data read from the wave memory is inputted into the multiplier 24. An envelope signal from the envelope generator 23 is inputted into the input terminal of the multiplier 24. The wave data is modified with the envelope signal. Into the envelope generator 23, data of the key code KC, the key on pulse KONP, key off pulse KOFP, the key velocity KV and the tone color number PC is inputted. The envelope generator generates the envelope signal according to the above mentioned data inputted from the register 20 as parameters. The musical tone data modified with the envelope signal is inputted into the multiplier 26. Volume data from the multiplier 25 is inputted into the multiplier 26. Data of the main volume VOL and the subvolume SVL are inputted into the multiplier 25. The multiplier 25 generates volume data by multiplying these data. This volume data is inputted into the multiplier 26. In the multiplier 26, the amplitude of the musical tone data is controlled by the volume data. The output data of all channels from the multiplier 26 is filtered, and therefore accumulated (added) by an accumulator 27. The accumulated musical tone data is inputted into a digital-to-analogue converter (A/D converter) 28 to convert the digital data into an analogue signal The analogue musical tone signal is inputted into a sound system 17 including voice speaker to make the signal audio tone.

FIG. 3 shows registers set in the RAM 13. The following is a description of names and functions of the registers.

N: key on register, a register storing the number of keys depressed by a player.

MOD: mode flag, a flag storing the dual mode or the normal mode

KCD(N): Key code register, a register storing key code of a key depressed by a player KVL: velocity register, a register storing key velocity of a key depressed by a player CHN(N,0), CHN(N,1): assign channel register, a register storing, at a dual mode, a channel assigned tone generation of a key depressed by a player OFKC: off key code register, a register storing a key code of a key released by a player VOICE(0): first tone color number register, a register storing a tone color number designated by the tone color switch VOICE(1): second tone color number register, a register storing a tone color number designated by the tone color switch SVOL(0), SVOL(1): subvolume register, a register storing balance data of tone volume between the first tone color and the second tone color The balance data of tone volume between the first tone color and the second tone color is stored in a tone volume balance table DVOL(VOICE(0), VOICE(1), 0/1). This table DVOL is configured with a three dimensional array table (all tone colors * all tone colors * two rows). Arguments of the table DVOL(VOICE(0), VOICE(1), 0/1) correspond to the axis of the table, respectively. Balance data of tone volume can be read when arbitrary numbers of the first tone color, the second tone color, and the first tone (i.e., "0") or the second tone (i.e., "1") are given to the table as parameters. Each balance data of tone volume is set within the range from "0" to "1". The balance data of tone volume is multiplied by the main volume data VOL and the subvolume data SVL in the tone generator 16.

FIGS. 4(A) to 4(D) illustrate flowcharts showing a process of the above mentioned electronic musical instrument.

Figure 4A:
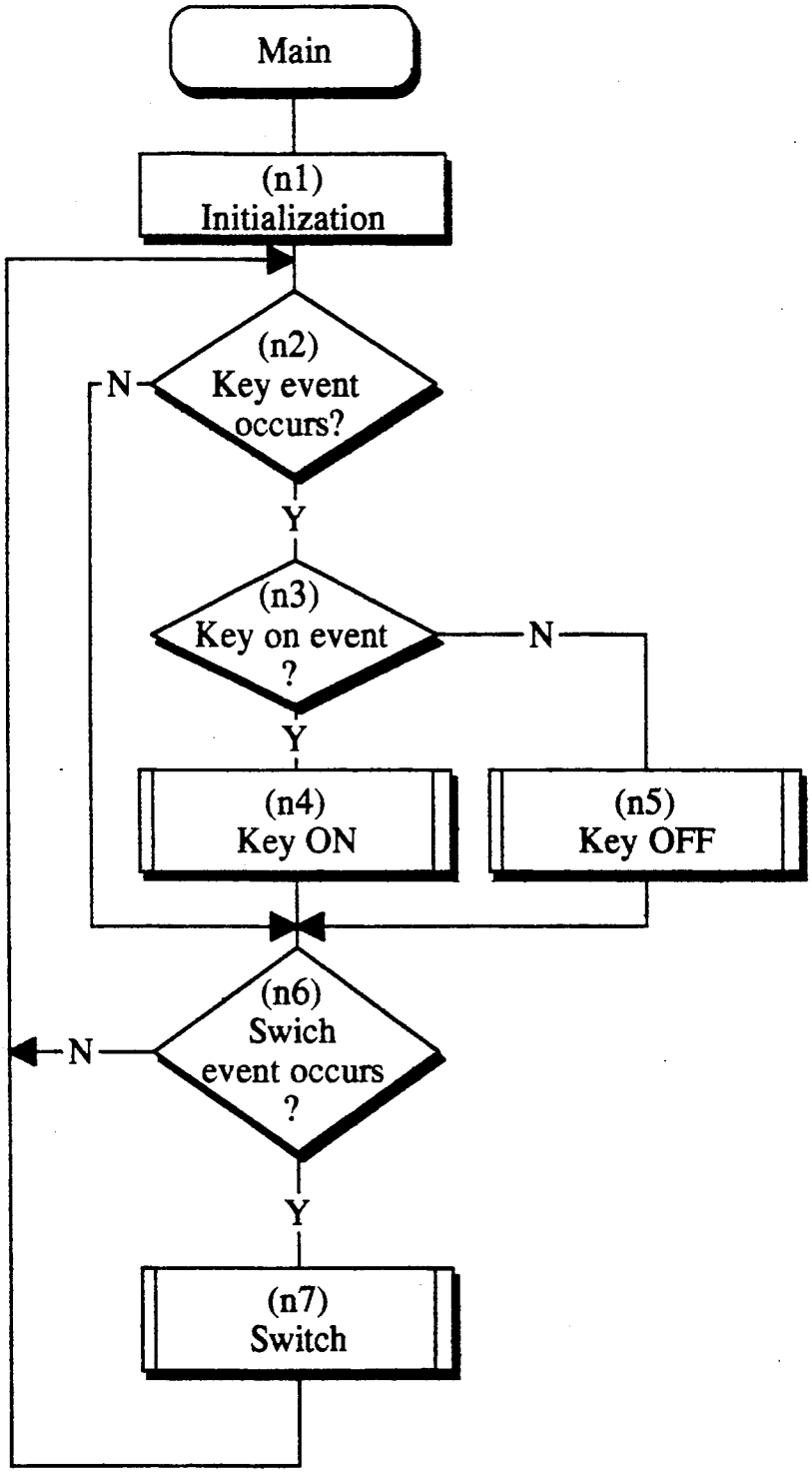
FIGS. 4(A) to 4(E) illustrate flow charts showing a process of the electronic musical instrument.

FIG. 4(A) illustrates a main routine.

When a power switch is turned on by a player, first, an initial setting step is performed (n1). The initial setting step works basically by beginning process of the CPU 10, for example,a reset process of some registers or a set process of basic tone color. After that, whether a key event or a switch event is occurred is judged (n2, n6). If any key event is judged, whether the key event is a key on event is judged (n3). If the key event is a key on event, a key on event process (n4) is performed, or else if the key event is a key off event, a key off event process is performed (n5). If any switch event is judged, switch event process (n7) is performed.

Figure 4B:
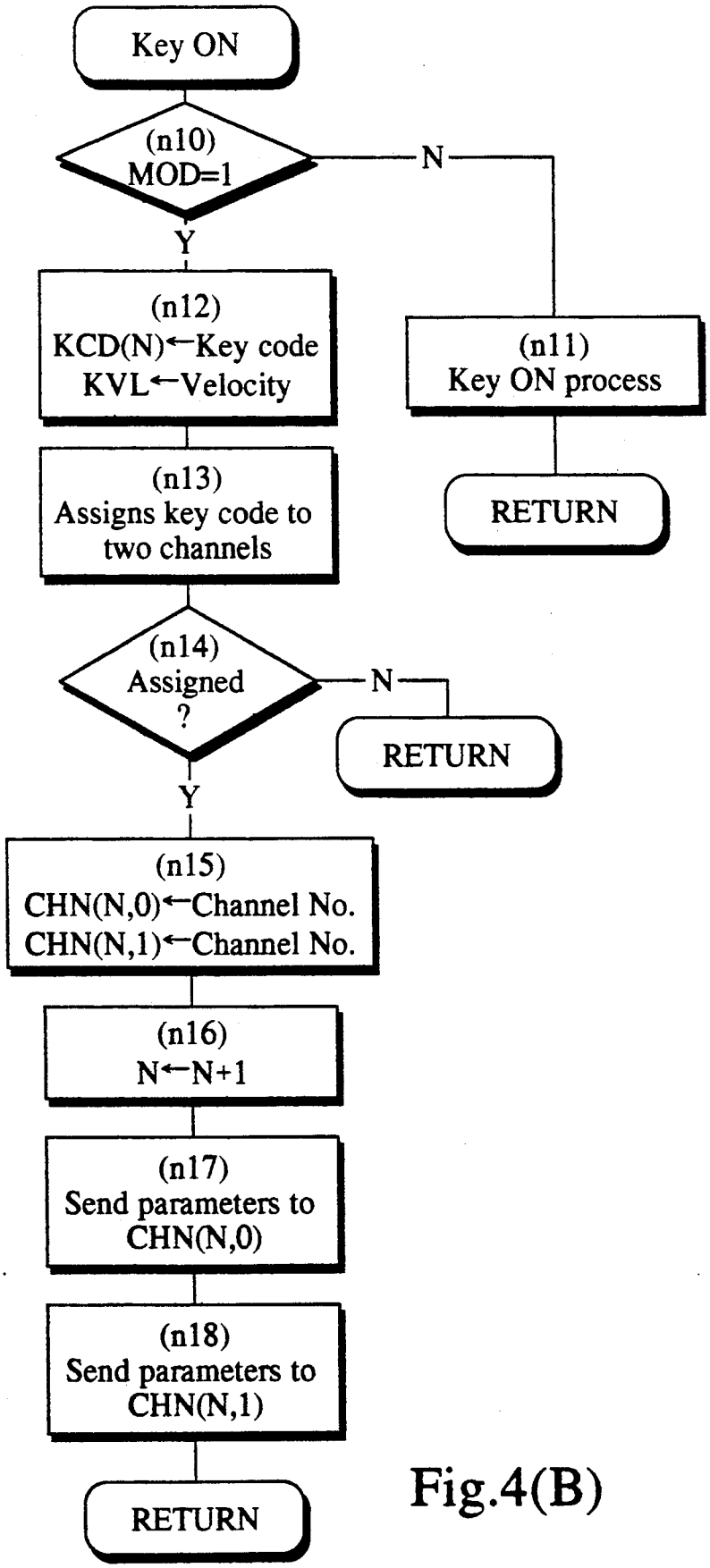
Figure 4C:
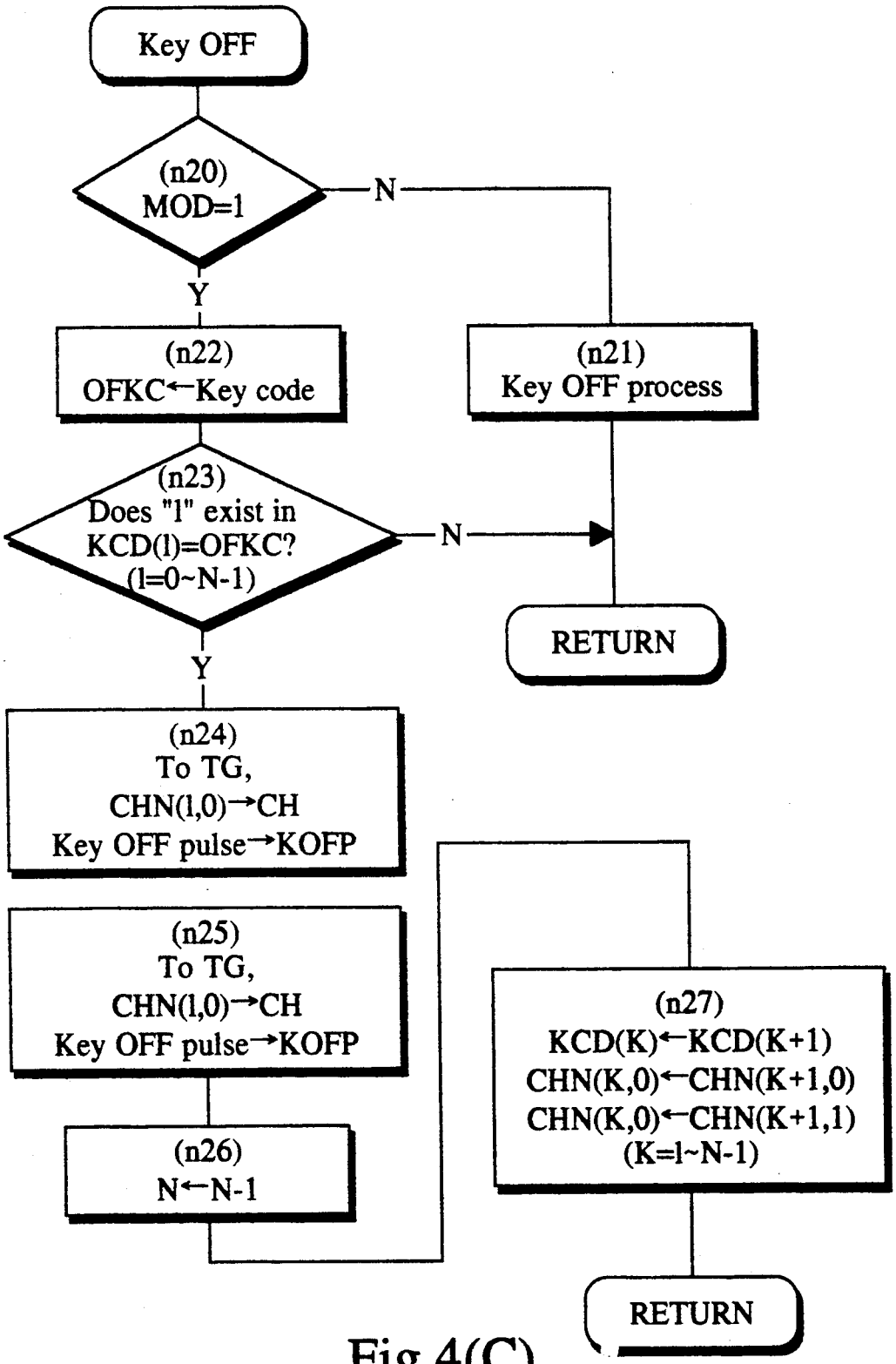
Figure 4D:
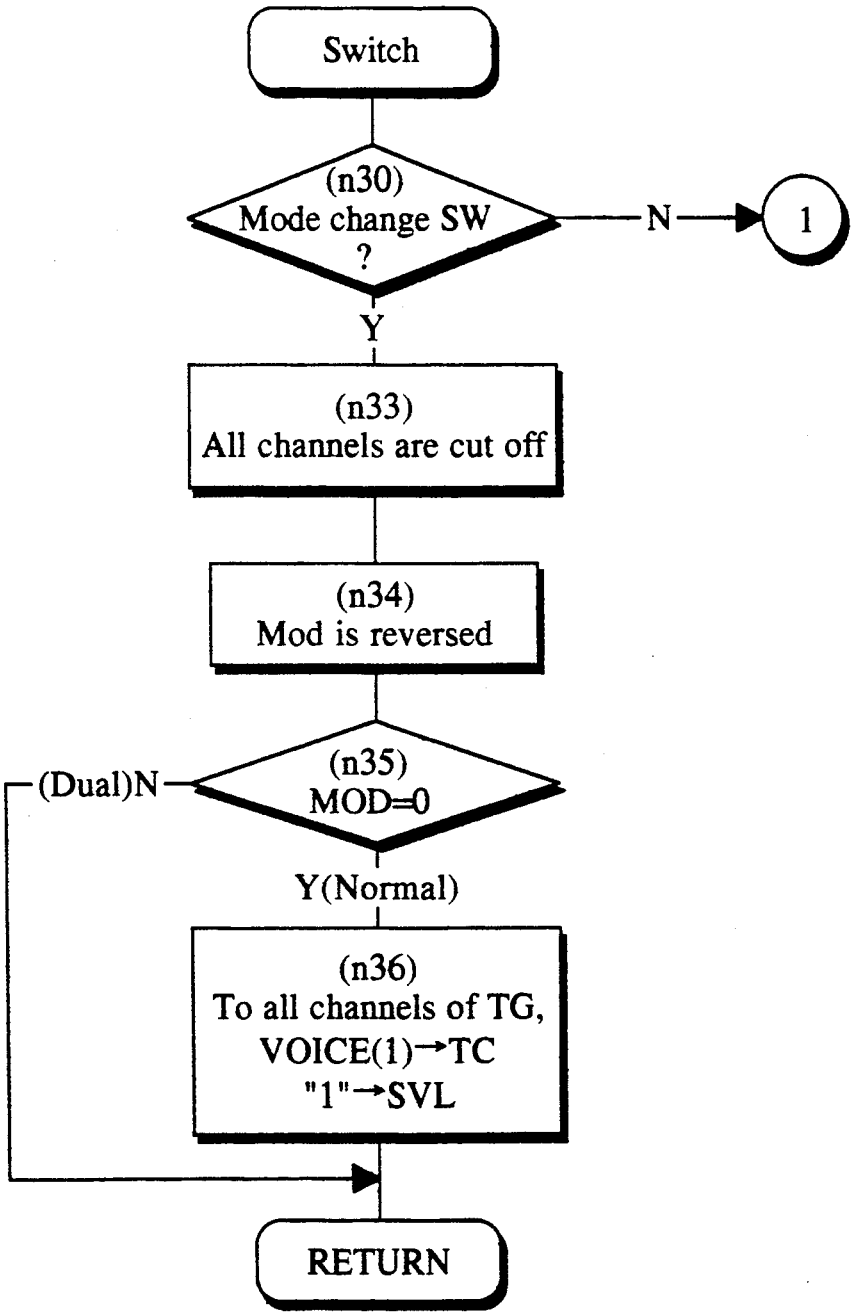
Figure 4E:
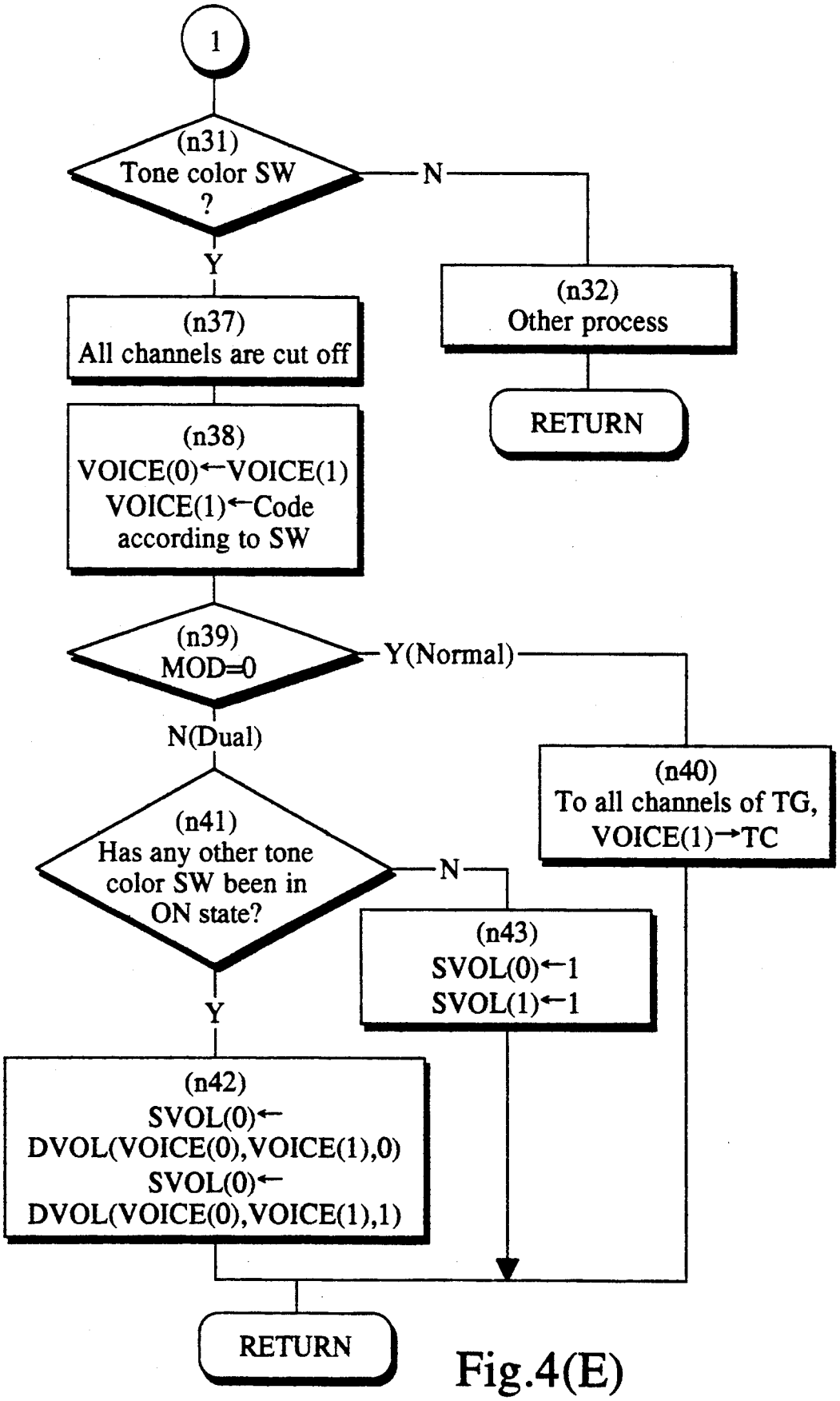

FIG. 4(D) and FIG. 4(E) show the switch event process.

First, whether the mode change switch or the tone color switch is on is judged (n30, n31). If neither of them is judged as being in on state, the other process is performed for the other switch functions (n32). If the mode change switch is turned on, the process goes to n33 from n30. In the step, musical tones of all tone generation channels are cut off to change the mode. Next, the mode flag MOD is reversed (n34). As a result of the reverse, if the mode flag MOD is in reset state, the present mode is the normal mode. In the normal mode, the second tone color number VOICE(1) is outputted into the tone generator 16 as a tone color number TC, and a value "1" is outputted into the tone generator as a subvolume SVL (n36). If the subvolume SVL equals "1", tone volume doesn't decay according to the subvolume SVL.

If the tone color switch is turned on, the process goes to n37 from n31. At n37, musical tones of all channels are cut off. At that time, data stored in the second tone color number register VOICE(1) is moved to the first tone color number register VOICE(0), the tone color number of the tone color switch presently turned on is stored into the second tone color number register VOICE(1) at (n38). Next, the mode flag MOD is judged (n39). If the mode flag MOD is in set state, the present mode is the dual mode. In the dual mode, whether the another tone color switch is in on state, that is, whether the switch previously turned on is in on state is judged (n41). If yes, balance data DVOL(VOICE(0),VOICE(1),0), DVOL(VOICE(0),VOICE(1),1) is read from the balance table of tone volume to make a difference between tone volume of the tone color corresponding to the previously turned-on tone color switch and tone volume of the tone color corresponding to the presently turned-on tone color switch, and thus the balance data is set into the subvolume register SVOL(0), SVOL(1) at (n42). If the previously turned-on tone color switch is presently in off state, the value "1" is set into both subvolume register SVOL(0), SVOL(1) (n43). While, if the mode is in the normal mode when any tone color switch is turned on, the tone color number (the second tone color number VOICE(1)) corresponding to the tone color switch turned on is outputted to all channels of the tone generator as a tone color number TC (n40).

FIG. 4(B) illustrates a flowchart showing the key on event process.

First, the mode flag state is judged at n10. If the mode flag MOD is in reset state, the present mode is the normal mode. The normal mode is a mode in which a single tone corresponds to a key turned on. In the normal mode, usual key on process is performed (n11) and the process returns. If the mode flag MOD is in set state, the present mode is the dual mode. The dual mode is a mode in which two tones correspond to a key turned on. In the dua' node, a key code of a key turned on is inputted into the key code register KCD(N), and velocity data of the key turned on is inputted into the velocity register KVL (n12). After that, two tone generation channels are assigned to generate tones based on the key turned on (n13). The step n15 and the forward steps are performed, provided that the assigned step n12 is performed correctly. If the step n13 isn't performed correctly, the process returns without tone generation based on the key turned on (n14). At n15, the assigned channel numbers are set into the channel number register CHN(N,0), CHN(N,1). At n16, the key on number register N is incremented. Parameters are outputted to the tone generator 16 to start tone generating in the two channels, CHN(N,0) and CHN(N,1) (n17, n18). The parameters include data of the key code KCD(N), the velocity KVL, the subvolume SVOL(0/1), the tone color number VOICE(0/1) and the channel number (0/1).

FIG. 4(C) illustrates a flow chart showing the key off event process.

First, the state of the mode flag MOD is judged (n20). If the mode flag MOD is in reset, the present mode is the normal mode, therefore, the usual key off process is performed (n21) and the process returns. If the mode flag MOD is in set state, the present process is the dual mode, therefore, a key code of a key turned off is outputted into the off key code register OFKC (n22). Next, The present channel according to the key code is searched in the key code register KCD(1) (1=0 to N-1) (n23). If there is no key code corresponding to the key turned off in the key code register KCD(1), that means the tone corresponding to the key code is not in tone generation state, therefore , the process returns. If the corresponding key code is found, the channel numbers CHN(1,0), CHN(1,1), which designate the channel numbers for the key code found, and the key off pulse KOFP are outputted to release the musical tones (n24.n25). Next, the key on number register N is decremented (n26). Therefore, the shift step n27 that data of the area (1+1) to (n−1) is shifted toward the area (1) in which the above-mentioned release data is stored (n27), and the process returns.

In the above-mentioned electronic musical instrument, the process for the tone volume balance can be applied to the split mode or the other modes as well as the dual mode. The balance table of tone volume can be configured in the RAM 13 in place of the ROM 12 to allow a player to set the data freely. It is possible that the tone volume balance adapts to all tone colors.

What is claimed is:

1. An electronic musical instrument having multivoice function comprising:
   musical tone generating means for simultaneously generating musical tones having a plurality of tone colors, each of said tone colors having a specified tone color number;
   tone color designating means for designating the plurality of tone colors;
   tone volume balance table means for storing balance data of tone volume between tones; and
   balance decision means for deciding a balance of tone volume, by looking up the tone volume balance table, between the tones of tone colors designated by an tone color designating means, according to the order specified by the tone color designating means.

2. An electronic musical instrument having multivoice function according to claim 1, further comprising tone generating channel assignment means for assigning a plurality of channels when a plurality of tones is designated, and tone balance assignment means for assigning said balance of tone volume to the plurality of channels.

3. An electronic musical instrument having multivoice function according to claim 1, wherein said musical tone generating means simultaneously generates musical tones at the same tone pitch.

4. An electronic musical instrument having multivoice function according to claim 1, wherein said musical tone generating means simultaneously generates musical tones at different tone pitches.

5. An electronic musical instrument having multivoice function according to claim 1, further comprising tone pitch designating means for designating a tone pitch to be generated, wherein said musical tone generating means simultaneously generates musical tones of a plurality of tone colors when the tone pitch designating means is operated.

6. An electronic musical instrument having multivoice function according to claim 5, wherein the tone pitch designating means comprises a keyboard means.

7. An electronic musical instrument having multivoice function according to claim 5, wherein the tone pitch designating means comprises string means.

8. An electronic musical instrument having multivoice function according to claim 1, wherein said balance data decides a first tone color volume and a second tone color volume.

9. An electronic musical instrument having multivoice function according to claim 1, wherein said designated tone color numbers include a first tone color number and a second tone color number, and said balance data is obtained from said tone volume balance table according to the first tone color number, the second tone color number, and a number of a designated tone color.

10. An electronic musical instrument having multivoice function according to claim 1, wherein each of said balance data is set within a range from 0 to 1.

11. An electronic musical instrument having multivoice function comprising:
   musical tone generating means for simultaneously generating musical tones having a plurality of tone colors;
   tone color designating means for designating the plurality of tone colors; and
   balance decision means for deciding automatically a balance of tone volume between the tone of tone colors designated by the tone color designating means, according to an order specified by the tone color designating means.

12. An electronic musical instrument having multivoice function according to claim 11, wherein said balance decision means comprises a tone volume balance table for storing balance data of the tone volume.

13. An electronic musical instrument having multivoice function according to claim 12, wherein said balance data decides a first tone color volume and a second tone color volume.

14. An electronic musical instrument having multivoice function according to claim 12, wherein said balance data is set within a range from 0 to 1.

15. An electronic musical instrument having multivoice function according to claim 11, wherein said musical tone generating means simultaneously generates musical tones at the same tone pitch.

16. An electronic musical instrument having multivoice function according to claim 11, wherein said musical tone generating means simultaneously generates musical tones at different tone pitches.

17. An electronic musical instrument having multi-voice function according to claim 11, further comprising tone pitch designating means for designating a tone pitch to be generated, wherein said musical tone generating means simultaneously generates musical tones of a plurality of tone colors when the tone pitch designating means is operated.

18. An electronic musical instrument having multi-voice function according to claim 17, wherein the tone pitch designating means comprises a keyboard means.

19. An electronic musical instrument having multi-voice function according to claim 17, wherein the tone pitch designating means comprises string means.

* * * * *